US009601037B1

(12) United States Patent
Ransom

(10) Patent No.: US 9,601,037 B1
(45) Date of Patent: Mar. 21, 2017

(54) HANGER DATE INDICATOR DEVICE

(71) Applicant: Sarisa Denise Ransom, Los Angeles, CA (US)

(72) Inventor: Sarisa Denise Ransom, Los Angeles, CA (US)

( * ) Notice: Subject to any disclaimer, the term of this patent is extended or adjusted under 35 U.S.C. 154(b) by 165 days.

(21) Appl. No.: 14/607,982

(22) Filed: Jan. 28, 2015

(51) Int. Cl.
*G09F 11/23* (2006.01)
*A47G 25/14* (2006.01)
*G09D 3/06* (2006.01)

(52) U.S. Cl.
CPC ..... *G09F 11/23* (2013.01); *A47G 25/1428* (2013.01); *G09D 3/06* (2013.01)

(58) Field of Classification Search
CPC ..... A47G 25/14; A47G 25/1407; A47G 25/1414; A47G 25/1421; A47G 25/1428; A47G 25/1435; G09F 3/06; G09F 11/23
USPC ..... 116/308, 309, 311, 312, 313, 314, 315, 116/316, 317, 318, 319, 320, 321, 322, 116/323, 324; 223/85, 88; 40/111, 113, 40/114, 322; D6/328
See application file for complete search history.

(56) References Cited

U.S. PATENT DOCUMENTS

| | | | | | |
|---|---|---|---|---|---|
| 926,794 | A | | 7/1909 | Weigle | |
| 1,544,844 | A | * | 7/1925 | Levkowits | A47G 25/1428 40/5 |
| 1,547,951 | A | | 7/1925 | Olson | |
| 1,563,735 | A | | 12/1925 | Fetters | |
| 2,076,133 | A | | 4/1937 | Melby | |
| 2,241,099 | A | | 5/1941 | Mills | |
| 2,398,873 | A | | 7/1944 | Ward | |
| 2,481,737 | A | | 12/1945 | Gartner | |
| 2,494,727 | A | | 5/1946 | Sloane | |
| 2,546,198 | A | | 9/1948 | Perlson | |
| 2,609,976 | A | | 9/1952 | Burk et al. | |
| 2,916,837 | A | * | 12/1959 | Bosland | G09D 3/06 40/114 |
| 3,124,284 | A | * | 3/1964 | Collum | A47G 25/1428 223/98 |
| 3,733,016 | A | | 5/1973 | Rood | |
| 3,860,153 | A | | 1/1975 | Davis, Jr. | |
| 3,967,766 | A | | 7/1976 | Hart | |
| 4,026,447 | A | | 5/1977 | Wnek | |
| 4,066,193 | A | | 1/1978 | Davis, Jr. | |
| 4,184,616 | A | | 1/1980 | Davis, Jr. | |

(Continued)

FOREIGN PATENT DOCUMENTS

| | | | | |
|---|---|---|---|---|
| DE | 19843514 A1 | * | 4/2000 | G09F 3/02 |
| DE | 102013005501 A1 | * | 10/2014 | A47G 25/1414 |

(Continued)

*Primary Examiner* — R. A. Smith

(74) *Attorney, Agent, or Firm* — Williams Intellectual Property; Benjamin F. Williams

(57) ABSTRACT

A hanger date indicator device additional to a clothes hanger by threadable engagement of a hanger hook through a central aperture to position and maintain the hanger date indicator device above an item of clothing depended upon the hanger. The hanger date indicator device includes a date indicator selectable upon a first surface thereof, said date indicator selectable to signal a date associative with an item of clothing depended upon the hanger, whereby a user is apprised of the last time the particular item of clothing was worn, the last time said item was washed, or of any other date desirable to associate with a particular item of clothing.

4 Claims, 4 Drawing Sheets

(56) References Cited

U.S. PATENT DOCUMENTS

| | | | | | |
|---|---|---|---|---|---|
| 4,886,010 | A * | 12/1989 | Stutzman | A47G 25/1407 | 116/308 |
| 5,499,466 | A * | 3/1996 | House | A47G 25/1428 | 40/322 |
| 5,526,968 | A * | 6/1996 | Larson | A47G 25/1407 | 116/323 |
| 5,564,361 | A | 10/1996 | Satterwhite | | |
| D430,219 | S * | 8/2000 | Chagan | D20/23 | |
| 7,246,730 | B2 * | 7/2007 | Russo | A47G 25/1407 | 116/308 |
| 7,334,359 | B1 * | 2/2008 | Palmer | G09F 3/00 | 223/98 |
| 8,069,595 | B2 * | 12/2011 | Aiezza | G09F 3/14 | 116/321 |
| 8,146,528 | B2 * | 4/2012 | Fralick | A61J 7/04 | 116/308 |
| 8,627,584 | B2 | 1/2014 | Aiezza | | |
| 8,708,302 | B2 | 4/2014 | Wilder | | |
| 9,380,902 | B2 * | 7/2016 | Kirkwood | A47G 25/1428 | |
| 2011/0089060 | A1 * | 4/2011 | Peyser | A47G 25/1407 | 206/278 |
| 2015/0136814 | A1 * | 5/2015 | Eden | A47G 25/1407 | 223/95 |

FOREIGN PATENT DOCUMENTS

| | | | | | |
|---|---|---|---|---|---|
| GB | 2328774 | A * | 3/1999 | G09F 11/00 | |
| GB | 2372697 | A * | 9/2002 | A47G 25/1428 | |
| WO | WO 2009121601 | A2 * | 10/2009 | A47G 25/1407 | |
| WO | WO 2011010091 | A2 * | 1/2011 | A47G 25/36 | |

* cited by examiner

HANGER DATE INDICATOR DEVICE

BACKGROUND OF THE INVENTION

Various types of clothes hangers and hanger indicators are known in the art. However, what is needed is a hanger date indicator device that is additional to a clothes hanger by threadable engagement of a hanger hook through a central aperture to position and maintain the hanger date indicator device above an item of clothing depended upon the hanger, said hanger date indicator device having a date indicator selectable upon a first surface thereof, said date indicator selectable to signal a date associative with an item of clothing depended upon the hanger, whereby a user is apprised of the last time the particular item of clothing was worn, the last time said item was washed, or of any other date desirable to associate with a particular item of clothing.

FIELD OF THE INVENTION

The present invention relates to a hanger date indicator device, and more particularly, to a hanger date indicator device that is additional to a clothes hanger by threadable engagement of a hanger hook through a central aperture to position and maintain the hanger date indicator device above an item of clothing depended upon the hanger, said hanger date indicator device having a date indicator selectable upon a first surface thereof, said date indicator selectable to signal a date associative with an item of clothing depended upon the hanger, whereby a user is apprised of the last time the particular item of clothing was worn, the last time said item was washed, or of any other date desirable to associate with a particular item of clothing.

SUMMARY OF THE INVENTION

The general purpose of the hanger date indicator device, described subsequently in greater detail, is to provide a hanger date indicator device which has many novel features that result in a hanger date indicator device which is not anticipated, rendered obvious, suggested, or even implied by prior art, either alone or in combination thereof.

It is often desirable to signal a date of use associated with a particular item of clothing, and display that date in close proximity to said article of clothing. The present hanger date indicator device, therefore, is additional to a clothes hanger to display a settable date in a position upon the hanger that does not effect the situation of clothing disposed upon the hanger nor the hanger's ability to hook to a suitable support.

The present hanger date indicator device, therefore, includes a hollow, open-bottomed body disposed with an aperture through the center wherethrough a hook of a hanger is threadable to situate the hanger date indicator device around the neck of said hanger, whereby a date signal is readable from a first surface of the hanger date indicator device in situation above an item of clothing depended from the hanger.

The present hanger date indicator device, therefore, includes a front surface and a rear surface. A date indicator is disposed upon the first surface, said date indicator settable to display a desired date. In an example embodiment disclosed herein, the date indicator includes a plurality of first dials and a plurality of second dials. The plurality of first dials includes a dial for rendering the date with two digits, thus at least one of the plurality of first dials includes a decagon disk with the digits "0" through "9" disposed edgewise upon each side. The other dial includes at least a "0" and a "1". A user may, therefore, enumerate the month of December with a "1" and a "2", for example. Other months are enumerable with their typical two-digit codes.

The plurality of second dials likewise includes a pair of dials usable for enumerating the day of the month. At least one of the plurality of second dials is likewise a decagon disk with digits "0" through "9" disposed edgewise on each side thereof. The other disk includes at least the digits "1", "2", and "3", whereby a user is enabled to enumerate any date range with two digits, as desired. Thus a date may be signaled atop an associated item of clothing as, for example, "12 24", meaning the last day the item was worn was in fact Christmas eve. Embodiments of the device are contemplated including a year indicator, as well.

A plurality of first indentations and a plurality of second indentations is disposed upon the rear surface of the device. The plurality of first indentations is disposed to accommodate the plurality of first dials of an adjacently disposed hanger date indicator device caused to abut the rear surface of the hanger date indicator device in question. The plurality of second indentations is likewise disposed to accommodate the plurality of second dials of an adjacently disposed hanger date indicator device caused to abut the rear surface of the hanger date indicator device in question. Thus multiple hanger date indicator devices are positional adjacent each other in a closet upon adjacently hung hangers, whereby space is conserved and direct contact between the first and second dials with the rear surface of an adjacent hanger date indicator device, which might otherwise cause inadvertent shifting of the dials, is preventable.

Thus has been broadly outlined the more important features of the present hanger date indicator device so that the detailed description thereof that follows may be better understood and in order that the present contribution to the art may be better appreciated.

Objects of the present hanger date indicator device, along with various novel features that characterize the invention are particularly pointed out in the claims forming a part of this disclosure. For better understanding of the hanger date indicator device, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
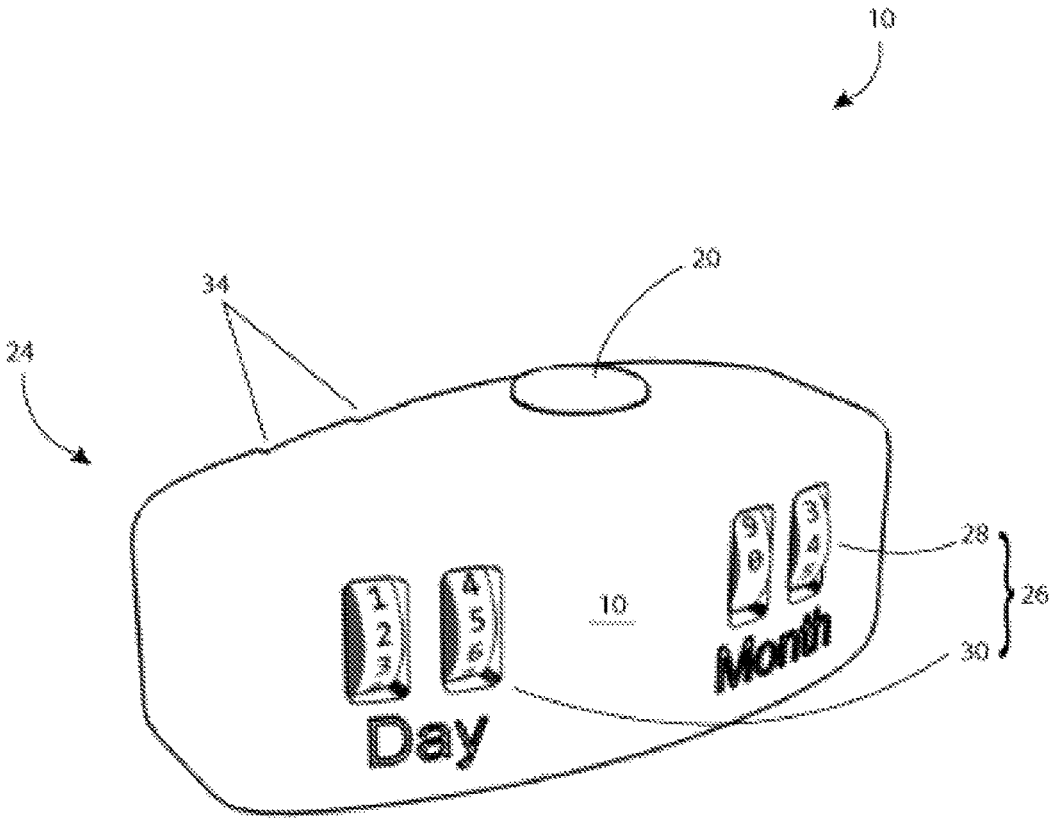
FIG. 1 is a front isometric view of an example embodiment.
Figure 2:
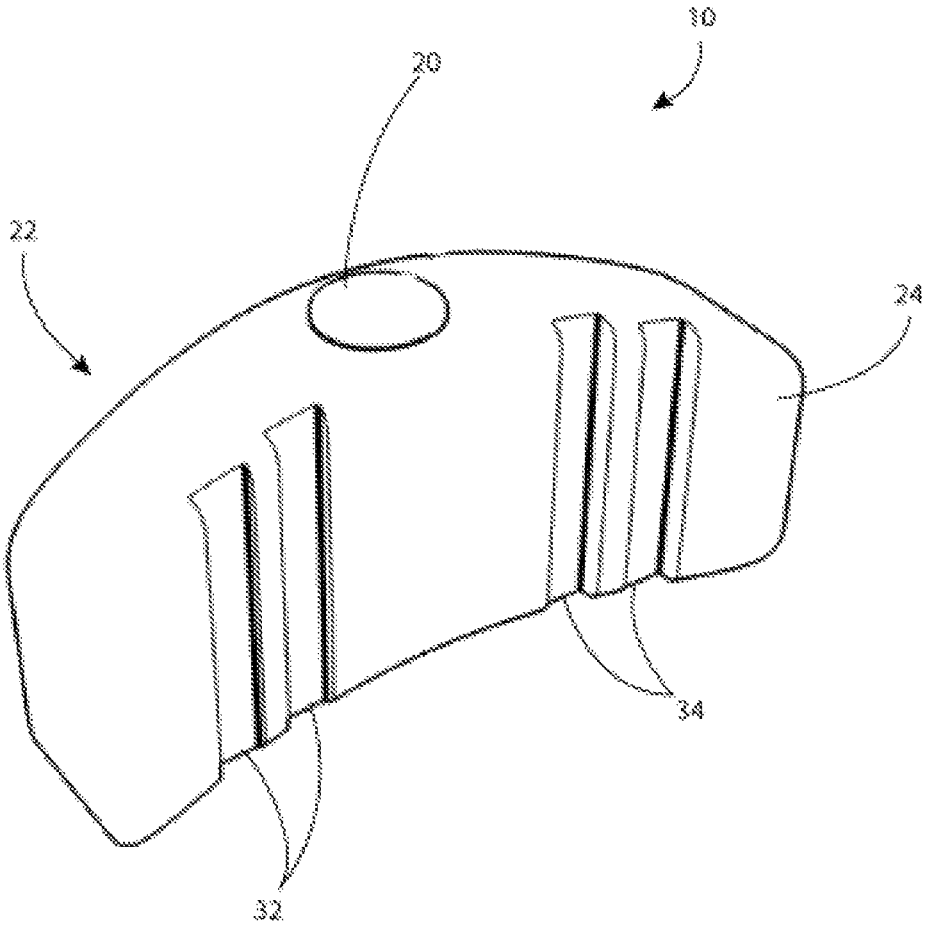
FIG. 2 is a rear isometric view of an example embodiment.
Figure 3:
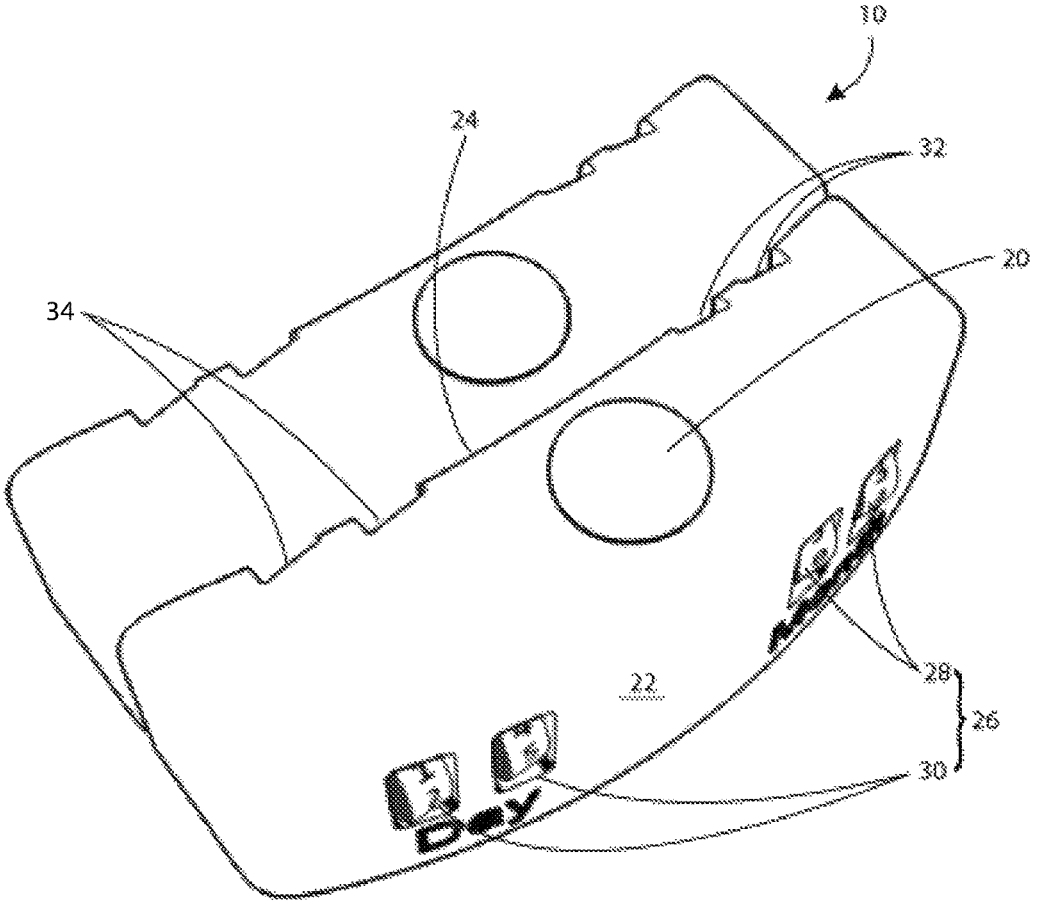
FIG. 3 is an elevated isometric view of an example embodiment of a hanger date display device conjunct an adjacently disposed hanger date display device and accommodating a first and second dial of said adjacently disposed hanger date display device.
Figure 4:
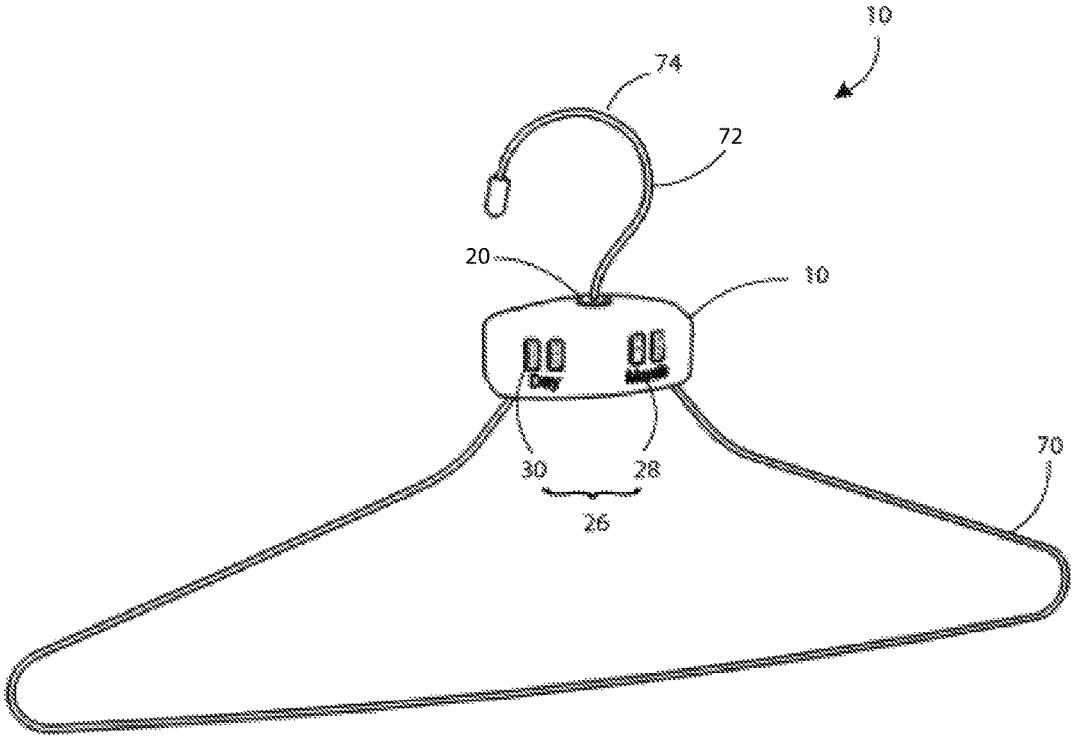
FIG. 4 is a front view of an example embodiment disposed upon a hanger.

With reference now to the drawings, and in particular FIGS. 1 through 4 thereof, example of the instant hanger date indicator device employing the principles and concepts of the present hanger date indicator device and generally designated by the reference number 10 will be described.

Referring to FIGS. 1 through 4 an example embodiment of the present hanger date indicator device 10 is illustrated.

The present hanger date indicator device 10 is additional to a hanger 70 to rest upon a neck 72 of a hook 74 of said hanger 20 without impeding the situation of any item of clothing depending from said hanger 70, whereby a date is displayable above the item of clothing to signal to a user the last time said item of clothing was worn, or cleaned, or to demark any other particular event a user may wish to enumerate by a particular date thereon in association with a particular item of clothing.

The present hanger date indicator device 10, therefore, includes an aperture 20 centrally disposed therein to accommodate a hanger 70 hook 74 therethrough. The hanger date indicator device 10 includes a front surface 22 and a rear surface 24. A settable date indicator 26 is disposed upon the front surface 22 having a plurality of first dials 28 and a plurality of second dials 30 vertically oriented for rotatable selection of a date to display. The plurality of first dials 28 is rotatable to display a selected month signal and the plurality of second dials 30 is rotatable to display a selected day signal.

A plurality of first indentations 32 and a plurality of second indentation 34 is disposed upon the rear surface 24. The plurality of first indentations 32 is disposed to accommodate the plurality of first dials 28 of any adjacently oriented hanger date indicator device 10 disposed upon an adjacent hanger 70, as case may be, and the plurality of second indentations 34 is likewise disposed to accommodate the plurality of second dials 30 of an adjacent hanger date indicator device 10 disposed upon an adjacent hanger 70. See FIG. 3, for example (hanger not shown).

The hanger date indicator device 10, therefore, is additional to a hanger 70 overlying an item of clothing depended from said hanger 70 without impeding the situation of the item of clothing upon the hanger 70, and a date is settable for display upon the hanger 70 to signal to a user the last time the item of clothing was worn (or to signal any other significant date a user may wish to display in association with said item of clothing). Each of the first and second indentations 32, 34 of the hanger date indicator device 10 is accommodative of the first and second dials 28, 30 respectively, of any adjacently disposed hanger date indicator device 10 disposed upon an adjacently positioned hanger 70, whereby conjunction of adjacent hangers 70 is enabled to conserve space, as desired, and inadvertent resetting of a signaled date is preventable from direct contact of each of the plurality of first and second dials 28, 30 with the rear surface 24 of an adjacently abutting hanger date indicator device 10, as may otherwise occur.

What is claimed is:

1. A hanger date indicator device additional to a hanger, said hanger date indicator device comprising:

a front surface;

a centrally disposed aperture devised to accommodate a hanger hook therethrough and the hanger date indicator device visibly above an item of clothing depended from the hanger;

a settable date indicator disposed upon the front surface, said settable date indicator comprising:

at least one first dial rotatable to display a month signal;

at least one second dial rotatable to display a day signal;

at least a first indentation and a second indentation disposed on a rear surface of said hanger date indicator, said first indentation disposed to accommodate the first dial of an adjacent hanger date indicator device disposed upon a hanger and said second indentation disposed to accommodate the second dial of an adjacent hanger date indicator device, whereby adjacently disposed hanger date indicator devices are positional abutting one another when disposed upon adjacently positioned hangers.

2. A hanger date indicator device additional to a hanger, said hanger date indicator device comprising:

an aperture centrally disposed therein to accommodate a hanger hook therethrough;

a front surface and a rear surface;

a settable date indicator disposed upon the front surface, said settable date indicator comprising:

at least a first dial and a second dial, said first dial rotatable to display a month signal, said second dial rotatable to display a day signal; and at least a first indentation and a second indentation disposed on the rear surface, said first indentation disposed to accommodate the first dial of an adjacent hanger date indicator disposed upon a hanger and said second indentation disposed to accommodate the second dial of an adjacent hanger date indicator device disposed upon a hanger;

wherein the hanger date indicator device is additional to a hanger overlying an item of clothing depended from said hanger without impeding situation of said clothing item upon said hanger, whereby a date is settable for display upon the hanger and each of the first and second indentations are accommodative of the first and second dials of any adjacently disposed hanger date indicator device disposed upon an adjacently positioned hanger.

3. The hanger date indicator device of claim 2 wherein the at least one first dial and at least one second dial each comprise at least one decagon disk vertically oriented in the first surface and rotatable therein to selectively display the digits "0" through "9" whereby two-digit codes are displayable for each of a selected month and day.

4. A hanger date indicator device additional to a hanger, said hanger date indicator device comprising:

an aperture centrally disposed therein to accommodate a hanger hook therethrough;

a front surface and a rear surface;

a settable date indicator disposed upon the front surface, said settable date indicator comprising:

a plurality of first dials comprising at least one decagon disk vertically oriented upon the first surface and rotatable therein to display digits of "0" through "9" to display a month signal in two-digit code;

a plurality of second dials comprising at least one decagon disk vertically oriented upon the first surface and rotatable therein to display digits of "0" through "9" to display a day signal in two-digit code;

at least a first indentation and a second indentation disposed on the rear surface, said first indentation disposed to accommodate the first dial of an adjacent hanger date indicator device disposed upon a hanger and said second indentation disposed to accommodate the second dial of an adjacent hanger date indicator device disposed upon a hanger;

wherein the hanger date indicator device is additional to a hanger overlying an item of clothing depended from said hanger without impeding situation of said clothing item upon said hanger, whereby a date is settable for display upon the hanger and each of the first and second indentations are accommodative of the first and second dials of any adjacently disposed hanger date indicator device disposed upon an adjacently positioned hanger.

* * * * *